US011351406B2

(12) United States Patent
Grant

(10) Patent No.: US 11,351,406 B2
(45) Date of Patent: Jun. 7, 2022

(54) ANCHORING STICK

(71) Applicant: Engineered Supply L.L.C., Bayport, MN (US)

(72) Inventor: Arlen Paul Grant, Stillwater, MN (US)

(73) Assignee: Engineered Supply L.L.C., Bayport, MN (US)

( * ) Notice: Subject to any disclaimer, the term of this patent is extended or adjusted under 35 U.S.C. 154(b) by 0 days.

(21) Appl. No.: 15/995,977

(22) Filed: Jun. 1, 2018

(65) Prior Publication Data

US 2018/0345055 A1 Dec. 6, 2018

Related U.S. Application Data

(60) Provisional application No. 62/513,915, filed on Jun. 1, 2017.

(51) Int. Cl.
*A62B 35/00* (2006.01)
*E04G 21/32* (2006.01)

(52) U.S. Cl.
CPC ..... *A62B 35/0068* (2013.01); *A62B 35/0075* (2013.01); *E04G 21/3276* (2013.01)

(58) Field of Classification Search
CPC ..... A62B 35/0068; A62B 35/0075; E04G 21/3276
See application file for complete search history.

(56) References Cited

U.S. PATENT DOCUMENTS 1,426,220 A * 8/1922 Sajtar ..... A01K 15/003 119/808
3,646,645 A * 3/1972 Bauer ..... B63B 21/08 294/82.35
4,751,892 A * 6/1988 Sechel ..... B63B 21/00 114/221 R
4,932,700 A * 6/1990 Hart ..... B25J 1/04 114/221 R
5,699,875 A * 12/1997 Dugan ..... A62B 35/0068 182/3
6,363,876 B1 * 4/2002 Blake ..... B63B 22/02 114/221 R
8,656,652 B1 * 2/2014 Carrillo ..... E01F 13/026 52/165

(Continued)

FOREIGN PATENT DOCUMENTS

DE 202012001808 U1 * 5/2013 ..... E04G 21/3276
DE 102015205715 A1 * 10/2016 ..... A62B 35/0068

(Continued)

OTHER PUBLICATIONS file:///C:/Users/cbradford/Documents/e-Red%20Folder/15995977/translation%20DE%20102015205715.pdf (Year: 2019).*

*Primary Examiner* — Colleen M Chavchavadze
*Assistant Examiner* — Candace L Bradford
(74) *Attorney, Agent, or Firm* — Laabs Intellectual Property

(57) ABSTRACT

In some embodiments, an anchoring stick comprises a shaft, a handle located at one end of the shaft and a hook located at the other end. The hook defines a cavity. The anchoring stick has a first orientation and a second orientation. A perimeter of the cavity comprises an opening in the first orientation. The cavity is defined by a closed perimeter in the second orientation.

16 Claims, 3 Drawing Sheets

(56) References Cited

U.S. PATENT DOCUMENTS

| | | | | |
|---|---|---|---|---|
| 8,894,329 | B1 * | 11/2014 | Kekahuna | F16B 13/066 405/259.4 |
| 9,469,025 | B1 * | 10/2016 | Ostrobrod | A62B 35/0068 |
| 10,143,866 | B2 * | 12/2018 | Yang | A63B 29/02 |
| 2002/0100244 | A1 * | 8/2002 | Carroll | E04G 21/3261 52/698 |
| 2012/0073900 | A1 * | 3/2012 | Cruz | E04G 21/3276 182/3 |
| 2016/0375282 | A1 * | 12/2016 | Sailer | E06C 7/18 182/90 |
| 2019/0040895 | A1 * | 2/2019 | Grant | F16B 13/0808 |

FOREIGN PATENT DOCUMENTS

| | | | | |
|---|---|---|---|---|
| DE | 202016105244 | U1 * | 10/2016 | A63B 29/02 |
| DE | 202018106454 | U1 * | 11/2018 | A62B 35/0068 |
| EP | 3088753 | A1 * | 11/2016 | F16G 15/06 |

* cited by examiner

ANCHORING STICK

CROSS-REFERENCE TO RELATED APPLICATIONS

This application claims the benefit of U.S. Application No. 62/513,915, filed Jun. 1, 2017, the entire content of which is hereby incorporated herein by reference.

BACKGROUND OF THE INVENTION

This invention relates generally to fall protection equipment and more particularly to an extension member used to engage a fall protection harness with a supporting anchor of a building.

Building anchors are often provided on tall buildings, and workers utilize fall protection equipment to engage the anchors. Anchors are often provided in locations that are difficult to reach or access. For example, an anchor may be located on a ceiling, and a ladder may be necessary to reach the anchor.

There remains a need for novel devices and methods for quickly and easily engaging a fall protection harness or lanyard to a supporting anchor.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an anchoring stick comprises a shaft. A first end of the shaft comprises a handle. A second end of the shaft comprises a cavity. The anchoring stick has a first orientation and a second orientation. A perimeter of the cavity comprises an opening in the first orientation. The cavity is defined by a closed perimeter in the second orientation.

In some embodiments, the anchoring stick comprises a first member and a second member, wherein the first member is moveable with respect to the second member. In some embodiments, the first member is rotatable with respect to the second member. In some embodiments, movement of the first member with respect to the second member can open and close the cavity.

In some embodiments, the anchoring stick comprises a locking mechanism arranged to prevent the cavity from opening. In some embodiments, the locking mechanism prevents the first member from moving with respect to the second member.

In some embodiments, the anchoring stick comprises a first member and a second member. The first member comprises an elongate tubular portion and a hook. The hook defines a cavity having an opening. The second member comprises a shaft and a cover. A portion of the shaft is oriented within the elongate tubular portion. The second member is moveable with respect to the first member. The second member having a first orientation where the cover is not positioned over the opening. The second member having a second orientation where the cover blocks the opening.

In some embodiments, a method comprises providing an anchoring stick comprising a hook defining a cavity and an opening into the cavity. A portion of a safety harness can be attached to the hook. In some embodiments, attaching the safety harness comprises orienting the hook through a loop of the safety harness. The anchoring stick can be attached to an anchor that is attached to a supporting surface. In some embodiments, the hook is positioned in a cavity defined by the anchor. The opening into the cavity is then closed. In some embodiments, closing the opening comprising moving the first member with respect to the second member.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
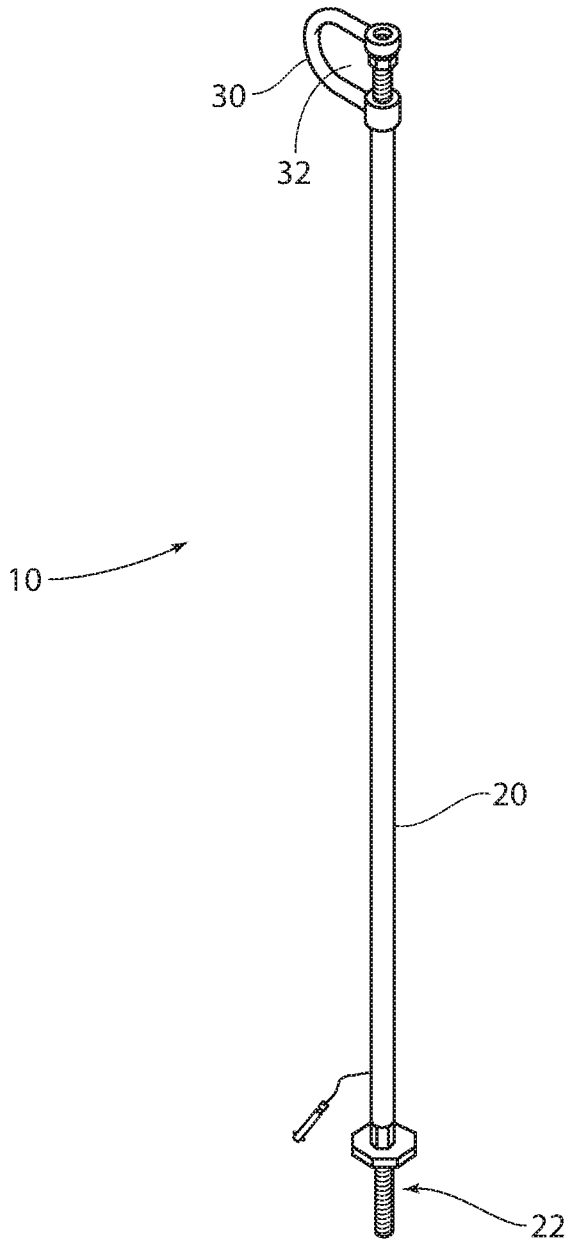
FIG. 1 shows an embodiment of an anchoring stick.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an anchoring stick 10. In some embodiments, an anchoring stick 10 comprises an elongate shaft 20, a handle 22 and a loop 30. In some embodiments, the handle 22 is located at a first end of the shaft 20 and the loop 30 is located at a second end of the shaft 20.

Desirably, the loop 30 is suitable for engaging a cable line or lanyard of a worker fall protection harness. Desirably, the loop 30 is suitable for engaging a building mounted anchor hoop.

In some embodiments, the loop 30 at least partially defines a cavity 32. In some embodiments, a portion of the shaft 20 also defines the cavity 32.

In some embodiments, the anchoring stick 10 comprises a first orientation wherein the cavity 32 comprises an open perimeter, and an opening into the cavity 32 is defined. In some embodiments, the anchoring stick 10 comprises a second orientation wherein the cavity 32 has a closed perimeter.

Figure 2:
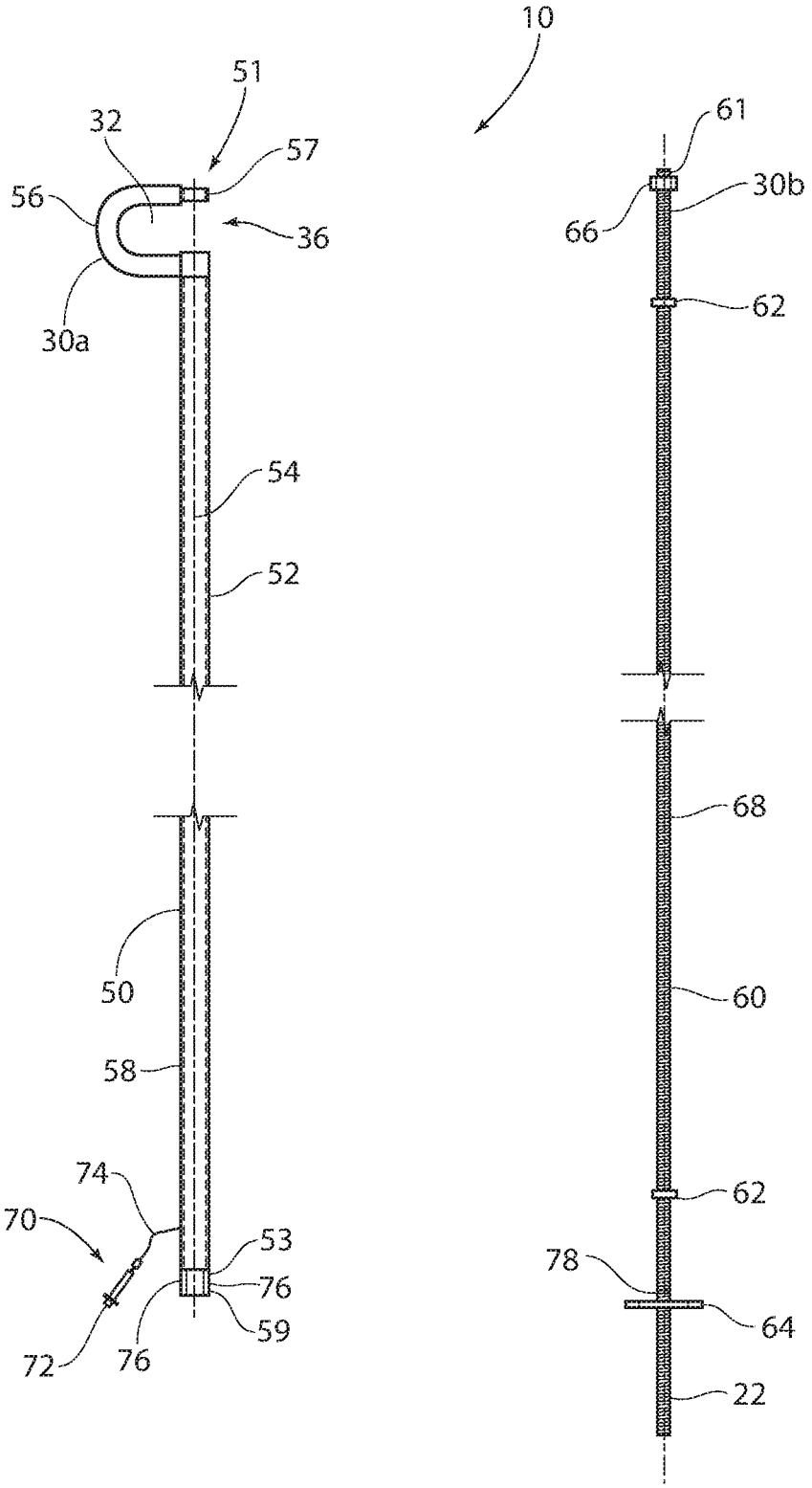
FIG. 2 shows an exploded view of an embodiment of an anchoring stick.

FIG. 2 shows an exploded view of an embodiment of an anchoring stick 10. In some embodiments, an anchoring stick 10 comprises a first member 50 and a second member 60. In some embodiments, the first member 50 is arranged to engage the second member 60 in a plurality of orientations. Any suitable engagement mechanism can be used. In some embodiments, the first member 50 and the second member 60 comprise complimentary threadings that provide engagement.

In some embodiments, the first member 50 comprises an elongate shaft 58 defining a central axis. In some embodiments, the shaft 58 comprises a tubular member comprising a sidewall 52 and an internal cavity or bore 54. The first member 50 can have any suitable cross-sectional shape. In some embodiments, the first member 50 comprises a circular cross-sectional shape. In some embodiments, the first member 50 comprises a non-circular cross-sectional shape, such as a square shape or other polygonal shape that is conducive to being gripped and/or twisted.

In some embodiments, the first member 50 comprises a hook 56. In some embodiments, the hook 56 comprises a first portion 30*a* of the loop 30. In some embodiments, the hook 56 partially defines the cavity 32. In some embodiments, the hook 56 defines an opening 36 into the cavity 32, wherein the cavity is offset from the central axis of the elongate shaft 58 and the opening 36 is positioned along the central axis. Desirably, the hook 56 can be used to engage the anchoring stick 10 with an anchor, such as a fall protection anchor provided on a building.

In some embodiments, the second member 60 comprises an elongate shaft 68. In some embodiments, at least a portion of the second member 60 is oriented within the bore 54 of the first member 50. In some embodiments, a length of the second member 60 is greater than a length of the first member 50, and one or more portions of the second member 60 will protrude from the first member 50. In some embodiments, the second member 60 comprises a handle 22, and the handle 22 protrudes from the first member 50.

In some embodiments, the second member 60 comprises a second portion 30*b* of the loop 30. In some embodiments, the second portion 30*b* is positionable over the opening 36 into the cavity 32, and the second member 60 can be arranged to close the loop 30.

In some embodiments, the second member 60 comprises a cover 30*b*. The second member 60 can have a first orientation where the cover 30*b* does not close the opening 36, and a second orientation where the cover 30*b* is positioned over the opening 36 and the cavity 32 is closed.

In some embodiments, the first member 50 comprises an engaging portion 51 that is arranged to engage the second member 60. In some embodiments, the engaging portion 51 of the first member 50 comprises threadings. In some embodiments, the engaging portion 51 of the first member 50 comprises a nut 57. In some embodiments, the engaging portion 51 is located at a first end of the hook 56, and a second end of the hook 56 is attached to the shaft 58.

In some embodiments, the second member 60 comprises an engaging portion 61 that is arranged to engage the first member 50. In some embodiments, the engaging portion 61 of the second member 60 comprises threadings, for example being configured to engage the nut 57. In some embodiments, threadings extend along an entire length of the shaft 68.

In some embodiments, the second member 60 comprises a stop 66. In some embodiments, the stop 66 is arranged to abut the first member 50 when the loop 30 is closed. In some embodiments, the stop 66 is arranged to abut the nut 57 when the loop 30 is closed.

In some embodiments, the stop 66 is also arranged to stop movement of the second member 60 with respect to the first member 50 when the opening 36 is open. For example, the stop 66 can also abut the shaft 58 near the hook 56 or the second end of the hook 56. In some embodiments, the stop 66 comprises a nut that is fixedly attached to the second member 60. The stop 66 can also prevent the second member 60 from disengaging the first member 50.

In some embodiments, the second member 60 comprises a guard 64. In some embodiments, the guard 64 is fixedly attached to the shaft 68. In some embodiments, the guard 64 functions as a stop and can abut the first member 50, for example when the cavity 32 is closed. In some embodiments, the guard 64 functions as a handle for grasping the second member 60. In some embodiments, an outer perimeter of the guard 64 comprises a non-circular cross-sectional shape.

In some embodiments, the anchoring stick 10 comprises one or more bushings 62 oriented between the first member 50 and the second member 60. In some embodiments, bushings 62 are sized to fit within the bore 54 of the first member 50. In some embodiments, bushings 62 help to center the second member 60 within the first member 50, for example encouraging a central axis the first member 50 and a central axis of the second member 60 to be collinear.

In some embodiments, the engaging portions 51, 61 of the first and second portions 50, 60 can be engaged and/or disengaged by rotating the first member 50 with respect to the second member 60. In some embodiments, the portions 50, 60 are arranged for a quick-release engagement, for example comprising a quarter-turn engagement mechanism, a push and turn engagement mechanism, a push-pin engagement mechanism or the like.

In some embodiments, the first member 50 comprises a secondary handle 59. In some embodiments, the secondary handle 59 is located at a proximal end of the first member 50. In some embodiments, the secondary handle 59 is located at an opposite end of the first member 50 from the hook 56. In some embodiments, the secondary handle 59 comprises a non-circular outer shape. In some embodiments, the shaft 58 of the first member 50 comprises a circular outer shape, and the secondary handle 59 comprises a non-circular shape. In some embodiments, the secondary handle 59 of the first member 50 and the handle 22 of the second member 60 can be grasped to move (e.g. rotate) the first member 50 with respect to the second member 60.

In some embodiments, the anchoring stick 10 comprises a second engagement portion 53 wherein the first portion 50 is engaged with the second portion 60. In some embodiments, the second engagement portion 53 comprises a nut. In some embodiments, the second engagement portion 53 comprises internal threadings arranged to engage threadings of the second portion 60. In some embodiments, the second engagement portion 53 is similar to the engagement portion 51. In some embodiments, the second engagement portion 53 comprises the secondary handle 59.

In some embodiments, the anchoring stick 10 comprises a locking mechanism 70 arranged to prevent the first member 50 and second member 60 from moving with respect to one another. Any suitable locking mechanism can be used. In some embodiments, the locking mechanism 70 comprises a pin 72, such as a quick release push-pin. In some embodiments, a pin 72 is attached to the anchoring stick 10, for example using a flexible tether 74. In some embodiments, the tether 74 is attached to the first member 50.

In some embodiments, the first member 50 comprises one or more apertures 76 arranged to receive the pin 72. In some embodiments, apertures 76 are formed in the sidewall 52 of the shaft 58. In some embodiments, apertures 76 are formed in the secondary handle 59.

In some embodiments, the second member 60 comprises a cavity 78 arranged to receive the pin 72. In some embodiments, the cavity 78 comprises a bore extending through the second member 60, for example in a direction lateral to the central axis of the shaft 68.

Figure 3:
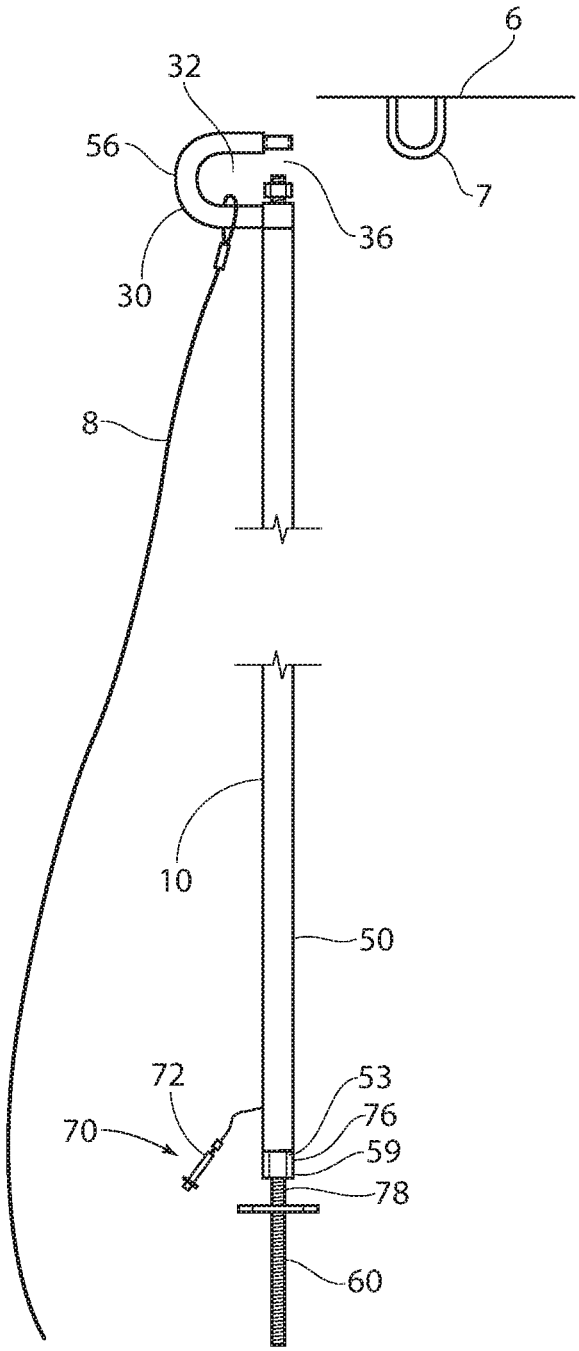
FIG. 3 shows an embodiment of an anchoring stick in a first orientation.

FIG. 3 shows an embodiment of an anchoring stick 10 in a first orientation. The loop 30 is open, wherein an opening 36 into the cavity 32 is defined. The first member 50 is in a first position with respect to the second member 60.

A lanyard 8 is shown attached to the hook 56. The lanyard 8 comprises a portion of a fall protection harness typically worn by workers. A building anchor 6 is also shown, which comprises a hoop 7. The anchoring stick 10 can be attached to the building anchor 6 by passing the hoop 7 through the opening 36, thereby positioning a portion of the hoop 7 in the cavity 32.

Figure 4:
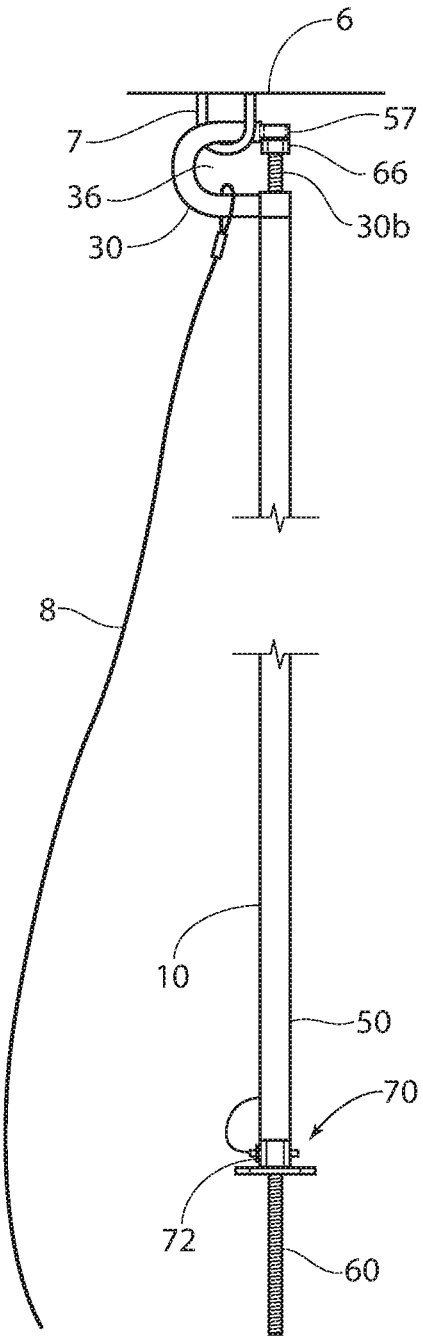
FIG. 4 shows the anchoring stick of FIG. 3 in a second orientation and engaged with a supporting anchor.

FIG. 4 shows the anchoring stick 10 in a second orientation and attached to the building anchor 6. The hoop 7 of the building anchor 6 extends through the cavity 32 of the loop 30. The loop 30 is closed and forms a closed perimeter about the cavity 32. The second portion 30*b* of the loop 30 is positioned to close the opening 36. The engaging portion 51 of the first member 50 is engaged with the engaging portion 61 of the second member 60. In some embodiments, a distal end of the first member 50 defines a cavity or aperture, and a distal end of the second member 60 is oriented in the cavity or extending through the aperture. In some embodiments, a threaded end portion of the second member 60 engages a nut 57 of the first member 50. In some embodiments, the stop 66 of the second member 60 abuts the first member 50. The anchoring stick 10 is safely attached to the building anchor 6.

The locking mechanism 70 can be used to lock the anchoring stick 10 in the orientation depicted in FIG. 4. In some embodiments, a locking pin 72 is arranged to engage the first member 50 and the second member 60 to retain their positions with respect to one another and lock the cavity 32 in the closed orientation.

A worker using an anchoring stick 10 can attach a fall protection lanyard 8 to the anchoring stick 10, then attach the anchoring stick 10 to the building anchor 6. The fall protection lanyard 8 becomes supported by the building anchor 6 using a convenient and fast procedure. Desirably, the anchoring stick 10 is of sufficient length to reach building anchors 6.

In some embodiments, a method comprises providing an anchoring stick 10 comprising an open cavity 32 that is constructed and arranged to be closed. A lanyard 8 can be attached to the anchoring stick 10, and the anchoring stick 10 can be attached to a building anchor, wherein the building anchor extends through the cavity 32. The cavity can be closed, thereby securely attaching the anchoring stick 10 to the building anchor, wherein the building anchor supports the lanyard 8.

In some embodiments, a method comprises providing an anchoring stick 10 comprising a hook 56 defining a cavity 32 and an opening 36 into the cavity 32. A portion of a safety harness 8 can be attached to the hook 56. In some embodiments, attaching the safety harness 8 comprises orienting the hook 56 through a loop of the safety harness 8 (see e.g. FIG. 3). The anchoring stick 10 can be attached to an anchor 7 that is attached to a supporting surface 6. In some embodiments, the hook 56 is positioned in a cavity defined by the anchor 7. The opening 36 into the cavity 32 is then closed (see e.g. FIG. 4.). In some embodiments, closing the opening 36 comprising moving the first member 50 with respect to the second member 60.

In some embodiments, a method further comprises opening the opening 36 into the cavity 32 and disengaging the anchoring stick 10 from the anchor 7.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An anchoring stick comprising:

a first member comprising a first handle portion, an elongate tubular portion and a hook, the elongate tubular portion comprising a central axis, the hook defining a cavity having an opening, the cavity offset from the central axis, the opening positioned along the central axis, the opening having a length as measured parallel to the central axis, a length of the elongate tubular portion being greater than the length of the opening; and a second member comprising a second handle portion, a guard, a shaft and a cover, a portion of the shaft oriented within the elongate tubular portion, the second member moveable with respect to the first member;

a bushing surrounding the second member, the bushing oriented within the elongate tubular portion;

the second member having a first orientation where the cover is not positioned over the opening, the second member having a second orientation where the cover blocks the opening and the guard contacts the first handle portion; and a locking mechanism comprising a pin extending through the first member and the second member.

2. The anchoring stick of claim 1, the second member comprising a handle.

3. The anchoring stick of claim 1, the second member comprising a rotation stop.

4. The anchoring stick of claim 1, the first member and the second member comprising complimentary threaded portions arranged to engage one another.

5. The anchoring stick of claim 4, the hook comprising an engaging portion, the cover comprising a complimentary engaging portion, in the first orientation the engaging portion not engaged with the complimentary engaging portion, in the second orientation, the engaging portion engaged with the complimentary engaging portion.

6. The anchoring stick of claim 5, the engaging portion comprising a nut fixedly attached to the first member.

7. The anchoring stick of claim 6, the complimentary engaging portion comprising threads formed in an outer surface of the shaft.

8. The anchoring stick of claim 1, comprising a first end and a second end, the cavity located at the first end, the orientation of the second member with respect to the first member adjustable from the second end.

9. The anchoring stick of claim 1, comprising a stop arranged to prevent the second member from disengaging the first member.

10. An anchoring stick comprising:

an elongate body comprising a first end and a second end, the first end comprising a hook, the second end comprising a handle, the handle comprising a first handle portion and a second handle portion;

the elongate body comprising a first member and a second member moveable with respect to the first member via the handle between a first orientation and a second orientation;

the first member comprising an elongate tubular portion and the hook, the elongate tubular portion comprising a central axis and the first handle portion, the hook defining a cavity, a first end of the hook attached to the elongate tubular portion, a second end of the hook comprising an internally threaded cavity aligned upon the central axis;

the second member comprising a first end, a second end and a guard, the second end comprising the second handle portion, the first end comprising a cover portion and a threaded end portion, the guard arranged to contact the first handle portion;

a bushing surrounding the second member, the bushing oriented within the elongate tubular portion;

in the first orientation, the cavity comprising an open perimeter comprising a lateral opening into the cavity;

in the second orientation, the threaded end portion of the second member engaged with the internally threaded cavity of the first portion and the cover portion positioned over the lateral opening, wherein the hook and cover portion form a closed perimeter surrounding the cavity.

11. The anchoring stick of claim 10, wherein a length of the elongate tubular portion as measured along the central axis is greater than a length of the cavity as measured along the central axis.

12. The anchoring stick of claim 10, wherein a length of the elongate tubular portion is greater than a length of the lateral opening into the cavity.

13. The anchoring stick of claim 10, wherein a length of the second handle portion as measured along the central axis is greater than a length of the cavity as measured along the central axis.

14. The anchoring stick of claim 10, the guard comprising a non-circular cross-sectional shape.

15. An anchoring stick comprising:

an elongate body comprising a first end and a second end, the first end comprising a hook, the second end comprising a handle, the handle comprising a first handle portion and a second handle portion;

the elongate body comprising a first member and a second member moveable with respect to the first member via the handle between a first orientation and a second orientation;

the first member comprising an elongate tubular portion and the hook, the elongate tubular portion comprising a central axis and the first handle portion, the hook defining a cavity, a first end of the hook attached to the elongate tubular portion, a second end of the hook comprising an internally threaded cavity aligned upon the central axis;

the second member comprising a first end and a second end, the second end comprising the second handle portion, the first end comprising a cover portion and a threaded end portion;

in the first orientation, the cavity comprising an open perimeter comprising a lateral opening into the cavity;

in the second orientation, the threaded end portion of the second member engaged with the internally threaded cavity of the first portion and the cover portion positioned over the lateral opening, wherein the hook and cover portion form a closed perimeter surrounding the cavity;

the second member comprising a rotation stop adjacent to the threaded end portion.

16. The anchoring stick of claim 15, the cover portion comprising the rotation stop.

* * * * *